United States Patent [19]

Swan et al.

[11] Patent Number: 4,613,423

[45] Date of Patent: Sep. 23, 1986

[54] CATALYTIC REFORMING PROCESS

[75] Inventors: George A. Swan; William C. Baird, Jr.; Robert G. Corry, all of Baton Rouge, La.

[73] Assignee: Exxon Research and Engineering Co., Florham Park, N.J.

[21] Appl. No.: 729,816

[22] Filed: May 2, 1985

[51] Int. Cl.[4] ..... C10G 35/06

[52] U.S. Cl. ..... 208/65; 208/63

[58] Field of Search ..... 208/65

[56] References Cited

U.S. PATENT DOCUMENTS

| | | | |
|---|---|---|---|
| 3,516,924 | 6/1970 | Forbes | 208/65 |
| 3,660,271 | 5/1972 | Keith et al. | 208/65 |
| 3,705,094 | 12/1972 | Keith et al. | 208/65 |
| 3,791,961 | 2/1974 | Sinfelt | 208/65 |
| 3,943,050 | 3/1976 | Bertolacini | 208/65 |
| 4,155,834 | 5/1979 | Gallagher | 208/65 |
| 4,167,473 | 9/1979 | Sikonia | 208/64 |
| 4,174,270 | 11/1979 | Mayes | 208/64 |
| 4,174,271 | 11/1979 | Mayes | 208/65 |

*Primary Examiner*—Curtis R. Davis

*Attorney, Agent, or Firm*—Llewellyn A. Proctor

[57] ABSTRACT

A process wherein, in a series of reforming zones, or reactors, each of which contains a bed, or beds of catalyst, the catalyst in the leading reforming zone, or zones, is constituted of supported platinum or supported platinum and rhenium, and the catalyst in the rearward reforming zone, or zones of the series, is constituted of platinum, rhenium, and iridium. The amount of (rhenium+iridium) relative to the platinum in the last reforming zone, or zones is present in weight ratio of at least about 1.5:1 and more preferably ranges from about 1.5:1 to about 10:1. The beds of catalyst are contacted with a hydrocarbon or naphtha feed, and hydrogen, at reforming conditions to produce a hydrocarbon, or naphtha product of improved octane, and the product is withdrawn.

55 Claims, No Drawings

CATALYTIC REFORMING PROCESS

BACKGROUND OF THE INVENTION

I. Field of the Invention

This invention relates to the catalytic reforming of naphthas and gasolines for the improvement of octane.

II. The Prior Art

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Platinum has been widely commercially used in recent years in the production of reforming catalysts, and platinum-on-alumina catalysts have been commercially employed in refineries for the last few decades. In the last decade, additional metallic components have been added to platinum as promoters to further improve the activity or selectivity, or both, of the basic platinum catalyst, e.g., iridium, rhenium, both iridium and rhenium, tin, and the like. Some catalysts possess superior activity, or selectivity, or both, as contrasted with other catalysts. Platinum-rhenium catalysts by way of example possess admirable selectivity as contrasted with platinum catalysts, selectivity being defined as the ability of the catalyst to produce high yields of $C_5+$ liquid products with concurrent low production of normally gaseous hydrocarbons, i.e., methane and other gaseous hydrocarbons, and coke.

In a reforming operation, one or a series of reactors, or a series of reaction zones, are employed. Typically, a series of reactors are employed, e.g., three or four reactors, these constituting the heart of the reforming unit. Each reforming reactor is generally provided with a fixed bed, or beds, of the catalyst which receive downflow feed, and each is provided with a preheater or interstage heater, because the reactions which take place are endothermic. A naphtha feed, with hydrogen, or recycle hydrogen gas, is co-currently passed through a preheat furnace and reactor, and then in sequence through subsequent interstage heaters and reactors of the series. The product from the last reactor is separated into a liquid fraction, and a vaporous effluent. The former is recovered as a $C_5+$ liquid product. The latter is a gas rich in hydrogen, and usually contains small amounts of normally gaseous hydrocarbons, from which hydrogen is separated and recycled to the process to minimize coke production.

The sum-total of the reforming reactions, supra, occurs as a continuum between the first and last reactor of the series, i.e., as the feed enters and passes over the first fixed catalyst bed of the first reactor and exits from the last fixed catalyst bed of the last reactor of the series. The reactions which predominate between the several reactors differ dependent principally upon the nature of the feed, and the temperature employed within the individual reactors. In the initial reaction zone, or first reactor, which is maintained at a relatively low temperature, conditions are established such that the primary reaction involves the dehydrogenation of cyclohexanes to produce aromatics. The isomerization of naphthenes, notably $C_5$ and $C_6$ naphthenes, also occurs to a considerable extent. Most of the other reforming reactions also occur, but only to a lesser, or smaller extent. There is relatively little hydrocracking, and very little olefin or paraffin dehydrocyclization occurs in the first reactor, or reaction zone. Within the intermediate reactor(s), or zone(s), the temperature is maintained somewhat higher than in the first, or lead reactor of the series, and the primary reactions in the intermediate reactor, or reactors, involve the isomerization of naphthenes and paraffins, dehydrogenation of naphthenes to yield aromatics, and dehydrocyclization of $C_8+$ paraffins to yield aromatics. Where, e.g., there are two reactors disposed between the first and last reactor of the series, some dehydrogenation of naphthenes may, and usually does occur, at least within the first of the intermediate reactors, or first portion of the reaction zone. There is usually some hydrocracking, at least more than in the lead reactor of the series, and there is more olefin and paraffin dehydrocyclization. The third reactor of the series, or second intermediate reactor, is generally operated at a somewhat higher temperature than the second reactor of the series. The naphthene and paraffin isomerization reactions generally continue in this reactor, and there is a further increase in paraffin dehydrocyclization, and more hydrocracking. In the final reactor, or final reaction zone, which is operated at the highest temperature of the series, paraffin dehydrocyclization, particularly the dehydrocyclization of the short chain, notably $C_6$ and $C_7$ paraffins, is the primary reaction. The isomerization reactions continue, and there is more hydrocracking in this reactor than in any of the other reactors of the series.

The activity of the catalyst gradually declines due to the build-up of coke. Coke formation is believed to result from the deposition of coke precursors such as anthracene, coronene, ovalene, and other condensed ring aromatic molecules on the catalyst, these polymerizing to form coke. During operation, the temperature of the process, or of the individual reactors, is gradually raised to compensate for the activity loss caused by the coke deposition. Eventually, however, economics dictate the necessity of reactivating the catalyst. Consequently, in all processes of this type the catalyst must necessarily be periodically regenerated by burning off the coke at controlled conditions.

Two major types of reforming are generally practiced in the multi-reactor units, both of which necessitate periodic reactivation of the catalyst, the initial sequence of which requires regeneration, i.e., burning the coke from the catalyst. Reactivation of the catalyst is then completed in a sequence of steps wherein the agglomerated metal hydrogenation-dehydrogenation components are atomically redispersed. In the semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various manifolding arrangements, motor operated valving and the like. The off-oil catalyst is regenerated to remove the coke deposits, and then reactivated while the other reactors of the series, which contain the on-oil catalyst, remain on stream. A "swing reactor" temporarily replaces a reactor which is removed from the series for regeneration and reactivation of the catalyst, until it is put back in series. Because of the flexibility offered by this type of "on-stream" catalyst regeneration, and reactivation, cyclic operations are operated at higher severities than semiregenerative operations, viz., at higher temperature and lower pressures.

Various improvements have been made in such processes to improve the performance of reforming catalysts in order to reduce capital investment or improve $C_5+$ liquid yields while improving the octane quality of naphthas and straight run gasolines. New catalysts have been developed, old catalysts have been modified, and process conditions have been altered in attempts to optimize the catalytic contribution of each charge of catalyst relative to a selected performance objective. Nonetheless, while any good commercial reforming catalyst must possess good activity, activity maintenance and selectivity to some degree, no catalyst can possess even one, much less all of these properties to the ultimate degree. Thus, one catalyst may possess relatively high activity, and relatively low selectivity and vice versa. Another may possess good selectivity, but its selectivity may be relatively low as regards another catalyst. Platinum-rhenium catalysts, among the handful of successful commercially known catalysts, maintain a rank of eminence as regards their selectivity; and they have good activity. Platinum-iridium catalysts have also been used commercially, and these on the other hand, are extremely active, and have acceptable selectivity. However, iridium metal is very expensive, and in extremely short supply. Therefore, despite the advantages offered by platinum-iridium catalysts the high cost, and lack of availability raise questions regarding the commercial use of iridium-containing catalysts. The demand for yet better catalysts, or ways to use presently known catalysts nonetheless continues because of the existing world-wide shortage in the supply of high octane naphtha, and the likelihood that this shortage will not soon be in balance with demand. Consequently, a relatively small increase in the $C_5+$ liquid yield, or decreased capital costs brought about by the use of catalysts with lesser loadings of precious metals, e.g., decreased iridium loadings, can represent large credits in commercial reforming operations.

Catalysts have been staged in various ways in catalytic reforming processes to achieve one performance objective, or another. Some perspective regarding such processes is given, e.g., in U.S. Pat. No. 4,436,612 which was issued on Mar. 13, 1984, to Oyekan and Swan, reference being made to Columns 3 and 4, respectively, of this patent. Both platinum-iridium and platinum-rhenium catalysts have been staged in one manner or another to improve reforming operations. Regarding the staging of platinum-rhenium catalysts, reference is made to U.S. Pat. No. 4,440,626-8 which issued on April 3, 1984, to U.S. Pat. No. 4,425,222 which issued on Jan. 10, 1984, and to U.S. Pat. No. 4,427,533 which issued Jan. 24, 1984. These patents, as well as U.S. Pat. No. 4,436,612, relate generally to processes wherein platinum-rhenium catalysts are staged, the amount of rhenium relative to the platinum being increased in the downstream reactors, i.e., in the final or tail reactor of the series, and in the intermediate reactor(s) of the series.

OBJECTS

Whereas these variations, and modifications have generally resulted in improving the process with respect to some selected performance objective, or another, and the specifically named patents describe processes wherein $C_5+$ liquid yields have been improved, inter alia, it is nonetheless desirable to provide a new and improved process which is capable of achieving yet higher conversions of the product to $C_5+$ liquid naphthas, especially at decreased capital costs brought about by the use of catalysts with decreased precious metals loadings, as contrasted with present reforming operations.

THE INVENTION

These objects and others are achieved in accordance with the present invention embodying a process of operating a reforming unit wherein, in one or a series of reactors each of which contains a bed, or beds, of reforming catalyst over which a naphtha feed, is passed thereover at reforming conditions, a portion of the total catalyst charged to the reactor, or reactors, is constituted of a platinum-rhenium-iridium catalyst concentrated within the most rearward portion of the reactor, or reactors of the series, while a platinum or platinum-rhenium catalyst is concentrated within the forward portion of the reactor, or reactors of the series. Preferably, the forwardmost portion of the reactor, or reactors, of the series contains a metal promoted platinum catalyst, suitably a low rhenium, rhenium promoted platinum catalyst, or catalyst which contains rhenium in concentration providing a weight ratio of rhenium:platinum of up to about 1.2:1, preferably up to about 1:1.

The present invention requires the use of a platinum-rhenium-iridium catalyst within the reforming zone wherein $C_6$–$C_7$ paraffin dehydrocyclization is the predominant reaction, and preferably this catalyst is employed in both the $C_6$–$C_7$ paraffin dehydrocyclization zone and upstream in the naphthenes and $C_8+$ paraffins isomerization and conversion zones. Within the $C_6$–$C_7$ paraffin dehydrocyclization zone, and preferably within both the $C_6$–$C_7$ paraffin dehydrocyclization and naphthenes and $C_8+$ paraffins isomerization and conversion zones, the sum total of the rhenium and iridium is present in the platinum-rhenium-iridium catalyst in weight concentration relative to the weight of the platinum in at least 1.5:1 concentration. In other words, the weight ratio of (rhenium plus iridium):platinum, i.e., (Re+Ir):Pt, is $\geqq 1.5:1$, and preferably ranges from about 1.5:1 to about 10:1, more preferably from about 2:1 to about 5:1. In such catalyst, the weight ratio of Ir:Re ranges no greater than about 1:1, and preferably the weight ratio of Ir:Re ranges from about 1:5 to about 1:1, more preferably from about 1:3 to about 1:1.

The present invention requires the use of the platinum-rhenium-iridium catalyst within the reforming zone wherein the primary, or predominant reaction involves the dehydrocyclization of $C_6$–$C_7$ paraffins, and olefins. The $C_6$–$C_7$ paraffin dehydrocyclization zone, where a series of reactors constitute the reforming unit, is invariably found in the last reactor, or final reactor of the series. Or, where there is only a single reactor, the $C_6$–$C_7$ paraffin dehydrocyclization reaction will predominate in the catalyst bed, or beds, at the product exit side of the reactor. The $C_6$–$C_7$ paraffin dehydrocyclization reaction predominates, generally, over about the final 30 percent of reactor space, based on the total on-oil catalyst. In the preferred embodiment, as suggested, the platinum-rhenium-iridium catalyst is employed in both the $C_6$–$C_7$ paraffin dehydrocyclization zone and upstream in the naphthenes and $C_8$+ paraffins isomerization and conversion zones following the zone wherein naphthene dehydrogenation is the primary, or predominant reaction.

A non-iridium containing catalyst, preferably a platinum-rhenium catalyst, is employed in the naphthene dehydrogenation zone. Suitably, the leading reforming zones, or reactors of the series are provided with platinum-rhenium catalysts wherein the weight ratio of the rhenium:platinum ranges from about 0.1:1 to about 1.2:1, preferably from about 0.3:1 to about 1:1.

In accordance with this invention, a platinum-rhenium-iridium catalyst representing up to about 85 percent, preferably up to about 50 percent, of the total on-oil catalyst employed in a reforming unit is provided within the rearwardmost reactor space, or rearwardmost reactors of a multiple reactor unit, while the remaining reactor space, or forwardmost reactors of the multiple reactor unit is provided with a platinum catalyst, or platinum-rhenium catalyst, preferably the latter. It has been found that the use of the platinum-rhenium-iridium catalyst in the $C_6$–$C_7$ paraffin dehydrocyclization zone, generally in the final, or tail reactor of a series of reactors, while the remaining reactor space is provided with a platinum-rhenium catalyst, will provide higher $C_5$+ liquid yields on a precious metal efficiency basis, particularly in cyclic operations, than operations otherwise similar except that all of the reactors of the unit are provided with an all platinum-rhenium catalyst, or similar platinum-rhenium-iridium catalyst. The same is generally true of reforming operations generally, but particularly true of semi-regenerative reforming operations, wherein both the $C_6$–$C_7$ paraffin dehydrocyclization zone and naphthene and $C_6$–$C_7$ paraffin isomerization and conversion zone, generally constituting the intermediate reactor, or reactors, and tail reactor of a reforming unit, are provided with the platinum-rhenium-iridium catalyst, while the remaining reactor space is provided with a platinum-rhenium catalyst. In conducting reforming operations, particularly cyclic reforming operations, it is thus preferred to charge the rearwardmost reactor, or reactors, of a reforming unit with up to about 30 percent, preferably with up to about 50 percent the on-oil catalyst as of platinum-rhenium-iridium catalyst, and the remaining reactor space, or reactors of the series, with up to about 70 percent, preferably up to about 50 percent of an on-oil catalyst as a platinum or a platinum-rhenium catalyst, preferably the latter. In all embodiments, the forwardmost reactor space of the reactors of an operating unit, constituting at least the lead reactor, will contain at least 15 percent, and preferably the lead reactor, or reactors, will contain not less than about 50 percent of on-oil catalyst as a platinum or a platinum-rhenium catalyst, preferably the latter. In a preferred operation, wherein four on-stream reactors are employed at any given period of operation, the tail reactor, of the series, particularly in a cyclic operation, will be charged with a platinum-rhenium-iridium catalyst while correspondingly the first three reactors of the series will be charged with a platinum or platinum-rhenium catalyst, preferably the latter. In another preferred operation employing four on-stream reactors, especially in a semi-regenerative reforming operation, both the third and fourth reactors of the series will be charged with a platinum-rhenium-iridium catalyst, while correspondingly the first and second reactors of the series will be charged with a platinum or a platinum-rhenium catalyst, preferably the latter.

It was found in staging the rhenium, and rhenium and iridium, promoted platinum catalysts in the several reactors of a reforming unit in this manner that significant activity and yield credits could be obtained vis-a-vis operations otherwise similar except that all of the reactors of the unit contained an all platinum-rhenium catalyst, or similar platinum-rhenium-iridium catalyst. The relative activity of a platinum-rhenium-iridium catalyst employed in accordance with the process of this invention is superior to that of a high rhenium, platinum-rhenium catalyst employed in a staged process as described in U.S. Pat. Nos. 4,436,612; 4,440,626-8; 4,425,222, and 4,427,533, supra, but not quite as high as that of an all platinum-iridium catalyst employed at corresponding conditions in the several reactors of a unit. Its activity, as would be expected, is between that of the platinum-iridium and high rhenium, platinum-iridium catalyst; essentially a straight line extrapolation, as would be expected. Not so however as regards the $C_5$+ liquid yield credits obtained with the platinum-rhenium-iridium catalyst employed in accordance with the process of this invention. Disproportionately high $C_5$+ liquid yields of corresponding octane number are obtained than obtained with the platinum-rhenium and high rhenium, platinum-rhenium catalysts, respectively. The reason for the synergistic effect of the platinum-rhenium and platinum-rhenium-iridium catalysts staged in this manner to provide increased $C_5$+ liquid yields at corresponding octane number is not known.

The catalyst employed in the process of this invention is necessarily constituted of composite particles which contain, besides a carrier or support material, and platinum and rhenium, or platinum, rhenium, and iridium hydrogenation-dehydrogenation components, a halide component and, preferably, the catalyst is sulfided. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 Å.

The metal hydrogenation-dehydrogenation components can be composited with or otherwise intimately associated with the porous inorganic oxide support or carrier by various techniques known to the art such as ion-exchange, coprecipitation with the alumina in the sol or gel form, or the like. For example, the catalyst composite can be formed by adding together suitable reagents such as a salt of platinum, a salt of rhenium, a salt of iridium, and ammonium hydroxide or carbonate, and a salt of aluminum such as aluminum chloride or aluminum sulfate to form aluminum hydroxide. The aluminum hydroxide containing the salts of platinum and rhenium, or platinum, rhenium, and iridium, can then be heated, dried, formed into pellets or extruded, and then calcined in nitrogen or other non-agglomerating atmosphere. The metal hydrogenation components can also be added to the catalyst by impregnation, typically via an "incipient wetness" technique which requires a minimum of solution so that the total solution is absorbed, initially or after some evaporation.

It is preferred to deposit the platinum and rhenium metals, or the platinum, rhenium, and iridium metals, and additional metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Platinum in absolute amount is usually supported on the carrier within the range of from about 0.01 to 3 percent, preferably from about 0.05 to 1 percent, based on the weight of the catalyst (dry basis). Rhenium, in absolute amount, is also usually supported on the carrier in concentration ranging from about 0.1 to about 3 percent, preferably from about 0.05 to about 1 percent, based on the weight of the catalyst (dry basis). Iridium, in absolute amount, is also supported on the carrier in concentration ranging from about 0.1 to about 3 percent, preferably from about 0.05 to about 1 percent, based on the weight of the catalyst (dry basis). The absolute concentration of each metal, of course, is preselected to provide the desired Ir:Re and (Re+Ir):Pt weight ratios, for a respective reactor of the unit, as heretofore expressed.

In compositing the metals with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. Where, e.g., platinum is to be deposited on the carrier, platinum chloride, platinum nitrate, chloroplatinic acid, ammonium chloroplatinate, potassium chloro platinate, platinum polyamine, platinum acetylacetonate, and the like, are preferably used. A promoter metal, or metal other than platinum and rhenium, or platinum, rhenium, and iridium, when employed, is added in concentration ranging from about 0.01 to 3 percent, preferably from about 0.05 to about 1 percent, based on the weight of the catalyst (dry basis).

In preparing catalysts, the metals are deposited from solution on the carrier in preselected amounts to provide the desired absolute amount, and weight ratio of each respective metal. Albeit the solution, or solutions, may be prepared to nominally contain the required amounts of metals with a high degree of precision, as is well known, chemical analysis will show that the finally prepared catalyst, or catalyst charged into a reactor, will generally deviate negatively or positively with respect to the preselected nominal values. In general however, where, e.g., the final catalyst is to contain 0.3 wt. % platinum and 0.7 wt. % rhenium, and 0.15 wt. % iridium the preparation can be controlled to provide within a 95% confidence level a range of ±0.03 wt. % platinum, ±0.05 wt. % rhenium, and ±0.03 wt. % iridium. Or where, e.g., the final catalyst is to contain 0.3 wt. % platinum, 0.3 wt. % rhenium, and 0.3 wt. % iridium, the preparation can be controlled to provide within a 95% confidence level a range ±0.03 wt. % platinum, ±0.03 wt. % rhenium, and ±0.03 wt. % iridium. Thus, a catalyst nominally containing 0.3 wt. % platinum, 0.7 wt. % rhenium, and 0.15 wt. % iridium is for practical purposes the equivalent of one which contains 0.3±0.03 wt. % platinum, 0.7±0.05 wt. % rhenium, and 0.15±0.03 wt. % iridium, and one which contains 0.3±0.03 wt. % platinum, 0.3±0.05 wt. % rhenium, and 0.15±0.03 wt. % iridium, respectively.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 1 to about 1.5 percent, based on the weight of the catalyst. When using chlorine as the halogen component, it is added to the catalyst within the range of about 0.2 to 2 percent, preferably within the range of about 1 to 1.5 percent, based on the weight of the catalyst. The introduction of halogen into the catalyst can be carried out by any method at any time. It can be added to the catalyst during catalyst preparation, for example, prior to, following or simultaneously with the incorporation of a metal hydrogenation-dehydrogenation component, or components. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 150° F. and 300° F., in the presence of nitrogen or oxygen, or both, in an air stream or under vacuum. The catalyst is calcined at a temperature between about 500° F. to 1200° F., preferably about 500° F. to 1000° F., either in the presence of oxygen in an air stream or in the presence of an inert gas such as nitrogen.

Sulfur is a highly preferred component of the platinum-rhenium and platinum-rhenium-iridium catalysts, the sulfur content of a catalyst generally ranging to about 0.2 percent, preferably from about 0.05 percent to about 0.15 percent, based on the weight of a catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperatues ranging from about 350° F. to about 1050° F. and at pressures ranging from about 1 to about 40 atmospheres for the time necessary to achieve breakthrough, or the desired sulfur level.

The feed or charge stock can be a virgin naphtha cracked naphtha, a naphtha from a coal liquefaction process, a Fischer-Tropsch naphtha, or the like. Such feeds can contain sulfur or nitrogen, or both, at fairly high levels. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 15 to about 80 vol. % paraffins, both normal and branched, which fall in the range of about $C_5$ to $C_{12}$, from about 10 to 80 vol. % of naphthenes falling within the range of from about $C_6$ to $C_{12}$, and from 5 through 20 vol. % of the desirable aromatics falling within the range of from about $C_6$ to $C_{12}$.

The reforming runs are initiated by adjusting the hydrogen and feed rates, and the temperature and pressure to operating conditions. The run is continued at optimum reforming conditions by adjustment of the major process variables, within the ranges described below:

| Major Operating Variables | Typical Process Conditions | Preferred Process Conditions |
|---|---|---|
| Pressure, psig | 50–750 | 100–500 |
| Reactor Temp., °F. | 800–1200 | 850–1050 |
| Recycle Gas Rate, SCF/B | 1000–10,000 | 1500–5000 |
| Feed Rate, W/Hr/W | 0.5–10 | 1–5 |

EXAMPLES

The invention will be more fully understood by reference to the following comparative data, inclusive of demonstrations and examples, which illustrate its more salient featues. All parts are given in terms of weight except as otherwise specified.

A series of platinum-rhenium catalysts were obtained from a commercial catalyst manufacturer, these having been prepared by impregnating these metals on alumina in conventional manner. Portions of particulate alumina of the type conventionally used in the manufacture of commercial reforming catalysts were prepared by precipitation techniques, and then extruded as extrudates. These portions of alumina, i.e., 1/16 inch diameter extrudates, were calcined for 3 hours at 1000° F. followed by equilibration with water vapor for 16 hours. Impregnation of metals upon the supports in each instance was achieved by adding $H_2PtCl_6$, $HReO_4$, and HCl in aqueous solution, while carbon dioxide was added as an impregnation aid. After a two hour equilibration, a mixture was filtered, dried, and then placed in a vacuum oven at 250° F. for a 3–4 hour period.

To prepare platinum-rhenium-iridium catalysts, portions of the dry platinum-rhenium catalysts were impregnated with an aqueous solution of $H_2IrCl_6$ and HCl, using carbon dioxide as an impregnation aid. The catalyst was separated from the solution by filtration, dried, and then placed in a vacuum oven at 250° F. for a 3–4 hour period.

In making the several runs wherein multiple-reactors constituted the reforming unit, four reactors were employed in series. The first reactor was charged with approximately 16 percent, and the second, third, and fourth reactor, respectively, were each charged with portions of catalyst constituting about 28 percent of the total on-oil catalyst charge, based on the weight of the total on-oil catalyst charged to the unit.

Prior to naphtha reforming, the catalyst was heated to 750° F. in 6% $O_2$ (94% $N_2$). Following 3 hours in 6% $O_2$ at 750° F., the catalyst was heated in 100% nitrogen to 932° F., reduced with 100% $H_2$ for 18 hours, and then presulfided with an admixture of 500 ppm $H_2S$ in hydrogen to achieve the desired catalyst sulfur level.

Inspections on the feed employed in the tests are given in Table I.

TABLE I

| | Light Paraffinic Naphtha |
|---|---|
| API Gravity | 59.7 |
| Sulfur, wppm | <0.1 to 0.5 |
| Nitrogen, wppm | <1 |
| Bromine No., qg/g | <1 |
| ASTM Distillation | |
| IBP°F. | 181 |
| 5% | 196 |
| 10 | 204 |
| 20 | 211 |
| 30 | 218 |
| 40 | 229 |
| 50 | 241 |
| 60 | 253 |
| 70 | 269 |
| 80 | 287 |
| 90 | 310 |
| 95 | 328 |
| FBP | 350 |

DEMONSTRATION

In a first simulated cyclic reforming run (Run 1), a low rhenium, platinum-rhenium catalyst was charged into each of the first three reactors of a four reactor unit, and a high rhenium, platinum-rhenium catalyst was charged into the last of the several reactors of the four reactor unit, and with all four reactors on-stream, the unit was prepared for conducting the run as previously described. In a second run (Run 2) all of the reactors of the unit were provided with platinum-rhenium-iridium catalyst, and the four reactor unit prepared for conducting the run as previously described. The runs were conducted by passing the Light paraffinic naphtha, which contained <0.1 wppm sulfur, through the series of reactors at 950° F. E.I.T., 175 psig, 3000 SCF/B which are the conditions necessary to produce a 100 RONC product. The results given in Table II were obtained, to wit:

TABLE II

| | Average Catalyst Activity Units | Yield $C_5$+ LV % | $H_2$ Wt. % | $CH_4$ Wt. % | LPG Wt. % |
|---|---|---|---|---|---|
| Run 1 (All Pt/Re)[1] | 54 | 74.6 | 2.63 | 2.03 | 9.8 |
| Run 2 (All Pt/Re/Ir)[2] | 80 | 75.3 | 2.51 | 2.66 | 8.8 |

[1]Reactors 1, 2, and 3: 0.3% Pt/0.3% Re/1.02% Cl/0.07% S; and Reactor 4: 0.3% Pt/0.7% Re/0.93% Cl/0.13% S.
[2]0.3% Pt/0.3% Re/0.3% Ir/1.18% Cl/0.15% S.

These data thus show that the use of the platinum-rhenium catalysts in all of the several reactors of the unit results in considerably less activity, and decreased $C_5$+ liquid yield. Although there is decreased $CH_4$ production, and more hydrogen produced, more light petroleum gases are produced with the unit employing all platinum-rhenium catalysts vis-a-vis the unit employing a trimetallic Pt-Re-Ir catalyst in all of the reactors.

EXAMPLE 1

A third run (Run 3) was conducted under similar conditions as the Demonstration runs with the same feed except that the two lead reactors were charged with the low rhenium catalysts employed in the first three reactors of the unit in Run 1, and the last two reactors were charged with the platinum-rhenium-iridium catalyst employed in Run 2. The results which are compared with the preceding demonstration runs are given in Table III.

TABLE III

| | Average Catalyst Activity Units | Yield $C_5^+$ LV % | $H_2$ Wt. % | $CH_4$ Wt. % | LPG |
|---|---|---|---|---|---|
| Run 1 (All Pt/Re) | 54 | 74.6 | 2.63 | 2.03 | 9.8 |
| Run 2 (All Pt/Re/Ir) | 80 | 75.3 | 2.51 | 2.66 | 8.8 |
| Run 3 (2 lead reactors:Pt/Re 2 last reactors: Pt/Re/Ir) | 75 | 75.3 | 2.63 | 2.47 | 8.9 |

A quite satisfactory $C_5^+$ liquid yield credit is thus obtained by staging the low rhenium-platinum-rhenium and platinum-rhenium-iridium catalysts as described, methane yield is satisfactory, and the activity of the catalyst is at least 90% as high as that of the all trimetallic catalyst. However, these advantages were obtained with only 55% as much iridium as employed in the all trimetallic catalyst run 2.

EXAMPLE 2

In other cyclic simulations, a fourth run (Run 4), dry, calcined platinum-rhenium catalysts were charged to the four reactors of a unit. These catalysts, after pretreatment, contained nominally, with respect to metals, 0.3% Pt/0.3% Re, and 1.02% Cl, and 0.07% S in the first three reactors of the series. The tail reactor, the fourth or last reactor of the series, was charged with a catalyst the composition of which was 0.3% Pt/0.7% Re/0.93% Cl/0.13% S. In a fifth run (Run 5) this same low rhenium, platinum-rhenium catalyst was charged into the first three reactors of a unit, and pretreated, while a platinum-rhenium-iridium catalyst was charged to the fourth, or tail reactor of a unit, and pretreated to provide a catalyst of the following composition: 0.3% Pt/0.7% Re/0.15% Ir, 0.9% Cl, 0.17% S. These runs were conducted with a paraffinic naphtha, which contained 0.5 wppm sulfur, at 950° F. E.I.T., 175 psig, 3000 SCF/B, at space velocity sufficient to produce a 102 RON product, with the result given in Table IV.

TABLE IV

| | Average Catalyst Activity Units | Yield $C_5^+$ LV % |
|---|---|---|
| Run 4 | 67 | 70.1 |
| Run 5 | 74 | 70.4 |

The advantages of the use of the trimetallic platinum-rhenium-iridium catalyst in the rearward reactor are apparent. The improvement in $C_5^+$ liquid yield, and catalyst activity is thus manifest.

EXAMPLE 3

Three additional runs were made (Runs 6, 7 and 8) each at simulated semi-regenerative conditions. In a first semi-regen simulation reforming run (Run 6), a single reactor was charged with a platinum-low rhenium catalyst, followed by a platinum-high rhenium catalyst (67% of total on-oil catalyst charge). The catalysts were pretreated to provide catalysts of the following composition, to wit: (1) 0.3% Pt/0.3% Re, 0.93% Cl, 0.07% S, and (2) 0.3% Pt/0.7% Re/0.95% Cl/0.11% S, respectively. In a second run (Run 7) the reactor was provided with a platinum-rhenium-iridium catalyst containing after pretreatment, a catalyst of the following composition to wit: 0.3% Pt/0.3% Re/0.3% Ir, 1.19% Cl/0.14% S. In a third run (Run 8) one-half of the reactor was provided with a low rhenium, platinum-rhenium catalyst of the following composition, to wit: 0.3% Pt/0.3% Re/1.02% Cl, 0.07% S as employed in the first 33% of the catalyst bed as in Run 6, and the last half of the reactor was provided with a platinum-rhenium-iridium catalyst of the following composition, to wit: 0.3% Pt/0.3% Re/0.3% Ir/1.24% Cl,0.11% S. Runs were then conducted by passing the light paraffinic naphtha, which contained 0.5 wppm sulfur, through the series of reactors at 182 psig, 3200 SCF/B to produce a 99 RONC product. The results given in Table V were obtained, to wit:

TABLE V

| | Average Catalyst Activity Units | Yield $C_5^+$ LV % | Relative Iridium Required |
|---|---|---|---|
| Run 6 | 58 | 74.5 | 0 |
| Run 7 | 73 | 75.5 | 1.0 |
| Run 8 | 68 | 75.5 | 0.5 |

These data show that the $C_5^+$ liquid yield for the staged low rhenium, platinum-rhenium/platinum-rhenium-iridium catalyst system produced as high a yield as the unit employing all platinum-rhenium-iridium catalyst, and with only one-half of the amount of iridium. This catalyst staged in this manner also produced 90% of the activity of the catalyst employed in Run 7. This catalyst system, of course, is far superior to the catalyst system used in Run 6 in both activity and $C_5^+$ liquid yield selectivity.

It is apparent that various modifications and changes can be made without departing from the spirit and scope of the present invention.

Other modes of operation can be imposed upon the present method of operation.

For example, on stream sulfur addition can aid in minimizing $C_4^-$ gas make. Trace quantities of sulfur, e.g., 0.05 to 10 wppm, added to the reforming unit during operation will thus increase $C_5^+$ liquid yields by reduction of $C_4^-$ gas production.

Naphthas can be reformed over platinum-rhenium-iridium catalysts under conditions such that the lead reactor(s) contain lesser amounts of Re and Ir, while subsequent reactors, e.g., the tail reactor of the series, contains higher amounts of Re and Ir to promote $C_5^+$ liquid yield, and improve catalyst activity.

Having described the invention, what is claimed is:

1. In a process for improving the octane quality of a naphtha in a reforming unit comprised of a plurality of serially connected reactors, inclusive of one or more lead reactors and a tail reactor, each of which contains a platinum or platinum-rhenium catalyst, the naphtha flowing in sequence from one reactor of the series to another and contacting the catalyst at reforming conditions in the presence of hydrogen, the improvement comprising, providing the tail reactor with a platinum-rhenium catalyst to which iridium has been added in amount sufficient to increase the $C_5^+$ liquid yield vis-a-vis a similar process utilizing in the tail reactor a platinum-rhenium catalyst to which no iridium has been added.

2. The process of claim 1 wherein the weight ratio of (Re+Ir):Pt in the tail reactor is 1.5:1, or greater.

3. The process of claim 1 wherein the weight ratio of (Re+Ir):Pt in the tail reactor ranges from about 1.5:1 to about 10:1.

4. The process of claim 3 wherein the (Re+Ir):Pt ratio ranges from about 2:1 to about 5:1.

5. The process of claim 3 wherein the iridium is added to the catalyst of the tail reactor in concentration providing a weight ratio of iridium:rhenium no greater than about 1:1.

6. The process of claim 5 wherein the weight ratio of iridium:rhenium ranges from about 1:5 to about 1:1.

7. The process of claim 3 wherein the catalyst of the tail reactor contains from about 0.01 to about 3 weight percent platinum.

8. The process of claim 7 wherein the catalyst of the tail reactor contains from about 0.05 to about 1 weight percent platinum.

9. The process of claim 3 wherein the catalyst of the tail reactor contains from about 0.1 to about 3 weight percent rhenium.

10. The process of claim 9 wherein the catalyst of the tail reactor contains from about 0.05 to about 1 weight percent rhenium.

11. The process of claim 3 wherein the catalyst of the tail reactor contains from about 0.1 to about 3 weight percent iridium.

12. The process of claim 11 wherein the catalyst of the tail reactor contains from about 0.05 weight percent to about 1 weight percent iridium.

13. The process of claim 1 wherein the catalyst of the tail reactor contains from about 0.05 to about 1 weight percent iridium, and sufficient platinum and rhenium to provide a weight ratio of (Re+Ir):Pt ranging from about 1.5:1 to about 10:1.

14. The process of claim 1 wherein the catalyst of the tail reactor contains from about 0.1 to about 3 weight percent halogen.

15. The process of claim 14 wherein the catalyst of the tail reactor contains from about 1 to about 1.5 weight percent halogen.

16. The process of claim 1 wherein the catalyst of the tail reactor is sulfided, and contains to about 0.2 weight percent sulfur.

17. The process of claim 15 wherein the catalyst of the tail reactor is sulfided, and contains from about 0.05 to about 0.15 weight percent sulfur.

18. In a process for reforming, with hydrogen, a naphtha feed in a reforming unit having at least one catalyst-containing on stream reactor through which the hydrogen and naphtha are heated and flowed to contact the catalyst at reforming conditions, the improvement comprising concentrating within the most rearward reaction zone of the said reforming unit up to about 30 percent, based on the total weight of on-oil catalyst in said reforming unit, of a rhenium and iridium promoted platinum catalyst, the weight ratio of (rhenium+iridium):platinum being at least about 1.5:1, and concentrating within the most forward reaction zone of said reforming unit a platinum catalyst, or rhenium promoted platinum catalyst which contains rhenium in concentration providing a weight ratio of rhenium:platinum up to about 1.2:1.

19. The process of claim 18 wherein the weight ratio of (Re+Ir):Pt in the most rearward reaction zone ranges from about 1.5:1 to about 10:1.

20. The process of claim 19 wherein the weight ratio of (Re+Ir):Pt in the most rearward reaction zone ranges from about 2:1 to about 5:1.

21. The process of claim 18 wherein the most rearward reaction zone of said reforming unit contains up to about 50 percent of said rhenium and iridium promoted platinum catalyst.

22. The process of claim 18 wherein the most rearward reaction zone of said reforming unit contains up to about 85 percent of said rhenium and iridium promoted platinum catalyst.

23. The process of claim 18 wherein the forward reaction zone of said reforming unit contains a platinum-rhenium catalyst.

24. The process of claim 18 wherein the iridium is added to the catalyst of the most rearward reaction zone of the reforming unit in concentration providing a weight ratio of iridium:rhenium no greater than about 1:1.

25. The process of claim 24 wherein the weight ratio of iridium:rhenium ranges from about 1:5 to about 1:1.

26. The process of claim 18 wherein the catalyst of the most rearward reaction zone of the reforming unit contains from about 0.01 to about 3 weight percent platinum.

27. The process of claim 26 wherein the catalyst of the most rearward reaction zone of the reforming unit contains from about 0.05 to about 1 weight percent platinum.

28. The process of claim 18 wherein the catalyst of the most rearward reaction zone of the reforming unit contains from about 0.1 to about 3 weight percent rhenium.

29. The process of claim 28 wherein the catalyst of the most rearward reaction zone of the reforming unit contains from about 0.05 to about 1 weight percent rhenium.

30. The process of claim 18 wherein the catalyst of the most rearward reaction zone of the reforming unit contains from about 0.1 to about 3 weight percent iridium.

31. The process of claim 30 wherein the catalyst of the most rearward reaction zone of the reforming unit contains from about 0.05 weight percent to about 1 weight percent iridium.

32. The process of claim 31 wherein the catalyst of the most rearward reaction zone of the reforming unit contains from about 0.05 to about 1 weight percent iridium, and sufficient platinum and rhenium to provide a weight ratio of (Re+Ir):Pt ranging from about 1:5 to about 10:1.

33. The process of claim 18 wherein the catalyst of the most rearward reaction zone of the reforming unit contains from about 0.1 to about 3 weight percent halogen.

34. The process of claim 23 wherein the catalyst of the most rearward reaction zone of the reforming unit contains from about 1 to about 1.5 weight percent halogen.

35. The process of claim 18 wherein the catalyst of the most rearward reaction zone of the reforming unit is sulfided, and contains to about 0.2 weight percent sulfur.

36. The process of claim 35 wherein the catalyst of the most rearward reaction zone of the reforming unit is sulfided, and contains from about 0.05 to about 0.15 weight percent sulfur.

37. In a process for reforming, with hydrogen, a naphtha feed in a reforming unit which contains a plurality of catalyst-containing on-stream reactors connected in series, the hydrogen and naphtha being heated and flowed from one reactor to another to contact the catalyst contained therein at reforming conditions, the improvement comprising concentrating within the most rearward reactors of the series from about 30 percent to about 85 percent, based on the total weight of catalyst in all of the reactors of the unit, of a rhenium and iridium promoted platinum catalyst, the weight ratio of (rhenium+iridium):platinum being at least about 1.5:1, and concentrating within the remaining reactor space a platinum catalyst, or rhenium promoted platinum catalyst which contains rhenium in concentration providing a weight ratio of rhenium:platinum up to about 1.2:1.

38. The process of claim 37 wherein the weight ratio of (Re+Ir):Pt in the most rearward reactors of the series ranges from about 1.5:1 to about 10:1.

39. The process of claim 38 wherein the weight ratio of (Re+Ir):Pt in the most rearward reactor of the series ranges from about 2:1 to about 5:1.

40. The process of claim 37 wherein the forward reaction space of said reforming unit contains a platinum-rhenium catalyst.

41. The process of claim 37 wherein the iridium is added to the catalyst of the most rearward reactors of the reforming unit in concentration providing a weight ratio of iridium:rhenium no greater than about 1:1.

42. The process of claim 41 wherein the weight ratio of iridium:rhenium ranges from about 1:5 to about 1:1.

43. The process of claim 37 wherein the catalyst of the most rearward reactors of the reforming unit contains from about 0.01 to about 3 weight percent platinum.

44. The process of claim 43 wherein the catalyst of the most rearward reactors of the reforming unit contains from about 0.05 to about 1 weight percent platinum.

45. The process of claim 37 wherein the catalyst of the most rearward reactors of the reforming unit contains from about 0.1 to about 3 weight percent rhenium.

46. The process of claim 45 wherein the catalyst of the most rearward reactors of the reforming unit contains from about 0.05 to about 1 weight percent rhenium.

47. The process of claim 37 wherein the catalyst of the most rearward reactors of the reforming unit contains from about 0.1 to about 3 weight percent iridium.

48. The process of claim 47 wherein the catalyst of the most rearward reactors of the reforming unit contains from about 0.05 weight percent to about 1 weight percent iridium.

49. The process of claim 48 wherein the catalyst of the most rearward reactors of the reforming unit contains from about 0.05 to about 1 weight percent iridium, and sufficient platinum and rhenium to provide a weight ratio of (Re+Ir):Pt ranging from about 1:5 to about 10:1.

50. In a process for reforming, with hydrogen, a naphtha feed in a reforming unit having at least one catalyst-containing on stream reactor through which the hydrogen and naphtha are heated and flowed to contact the catalyst at reforming conditions through a naphthene dehydrogenation zone, naphthenes and $C_8$+ paraffins isomerization and conversion zones, and $C_6$–$C_7$ paraffin dehydrocyclization zones, the improvement comprising concentrating within the naphthenes and $C_8$+ paraffins isomerization and conversion zones and said $C_6$–$C_7$ paraffin dehydrocyclization zones of the reactor a rhenium and iridium promoted platinum catalyst, the weight ratio of (rhenium+iridium):platinum being at least about 1.5:1, and concentrating within the naphthene dehydrogenation zone of the reactor a rhenium promoted platinum catalyst which contains rhenium in concentration providing a weight ratio of rhenium:platinum of up to about 1.2:1.

51. The process of claim 50 wherein the weight ratio of (Re+Ir):Pt in the naphthenes and $C_8$+ paraffins isomerization and conversion zones and said $C_6$–$C_7$ paraffin dehydrocyclization zones of the reactor ranges from about 1.5:1 to about 10:1.

52. The process of claim 51 wherein the weight ratio of (Re+Ir):Pt in the naphthenes and $C_8$+ paraffins isomerization and conversion zones and said $C_6$–$C_7$ paraffin dehydrocyclization zones of the reactor ranges from about 2:1 to about 5:1.

53. In a process for reforming, with hydrogen, a naphtha feed in a reforming unit which contains a plurality of catalyst-containing on-stream reactors connected in series, the hydrogen and naphtha being heated and flowed from one reactor to another to contact the catalyst contained therein at reforming conditions through a series of naphthene dehydrogenation, naphthenes and $C_8$+ paraffins isomerization and conversion zones and $C_6$–$C_7$ paraffin dehydrocyclization zones, the improvement comprising concentrating within the naphthenes and $C_8$+ paraffins isomerization and conversion zones and $C_6$–$C_7$ paraffin dehydrocyclization zones within the series of reactors a rhenium and iridium promoted platinum catalyst which contains rhenium in concentration providing a weight ratio of (rhenium+iridium):platinum of at least about 1.5:1, and concentrating within the naphthene dehydrogenation zone of the series a rhenium promoted platinum catalyst which contains rhenium in concentration providing a weight ratio of rhenium:platinum of up to about 1.2:1.

54. The process of claim 53 wherein the weight ratio of (Re+Ir):Pt in the naphthenes and $C_8$+ paraffins isomerization and conversion zones and $C_6$–$C_7$ paraffin dehydrocyclization zones of the series of reactors ranges from about 1.5:1 to about 10:1.

55. The process of claim 54 wherein the weight ratio of (Re+Ir):Pt in the naphthenes and $C_8$+ paraffins isomerization and conversion zones and $C_6$–$C_7$ paraffin dehydrocyclization zones of the series of reactors ranges from about 2:1 to about 5:1.

* * * * *